US006237169B1

(12) United States Patent
Ying

(10) Patent No.: US 6,237,169 B1
(45) Date of Patent: May 29, 2001

(54) FOLDABLE TRAMPOLINE

(76) Inventor: Lai Fen Ying, P.O. Box 453, Taichung (TW)

( * ) Notice: Subject to any disclaimer, the term of this patent is extended or adjusted under 35 U.S.C. 154(b) by 0 days.

(21) Appl. No.: 09/421,195

(22) Filed: Oct. 18, 1999

(51) Int. Cl.[7] ..... A63B 5/08
(52) U.S. Cl. ..... 5/111; 5/187; 5/174; 482/27
(58) Field of Search ..... 5/110, 111, 187, 5/199, 179, 201, 282.1, 286, 310; 982/27–28; 182/139

(56) References Cited

U.S. PATENT DOCUMENTS

| | | | | |
|---|---|---|---|---|
| 1,267,352 | * | 5/1918 | Baker | 5/200.1 |
| 2,076,811 | * | 4/1937 | Ehlers | 5/200.1 X |
| 3,891,208 | * | 6/1975 | Sidlinger | 5/187 |
| 4,415,151 | * | 11/1983 | Daniels | 482/27 |
| 4,452,444 | * | 6/1984 | Schulze, Jr. | 5/199 |
| 5,545,110 | * | 8/1996 | Hsiang | 482/27 |

* cited by examiner

*Primary Examiner*—Michael F. Trettel
(74) *Attorney, Agent, or Firm*—Harrison & Egbert

(57) ABSTRACT

A foldable trampoline having a jump cloth, a plurality of pull rods secured to cloth ears extending around the jump cloth, a frame having a plurality of hook holes formed on a top surface thereof, a plurality of spring elements engaged with the pull rods and within the hook holes, and a plurality of support rods respectively engaged within a plurality of thread holes formed on the frame. The frame is formed of a plurality of sections. One pair of sections has an L-shaped member with a thread hole formed at one end thereof. This pair of sections also has an upper strut extending outwardly from an upper end thereof. The thread hole of the L-shaped member is received within the end having the upper strut such that the thread hole of the L-shaped member is aligned with a thread hole formed on a bottom surface of the opposite end of the frame. Support rods can be extended through the various thread holes formed on the bottom sides of the frame so as to lock the frame sections together in a foldable arrangement.

3 Claims, 8 Drawing Sheets

FOLDABLE TRAMPOLINE

FIELD OF THE INVENTION

The present invention relates generally to a trampoline, and more particularly to a foldable trampoline.

BACKGROUND OF THE INVENTION

The construction of the conventional trampoline is simple and unfoldable. Moreover, the connection between the spring clement and the frame arc easily loosened. This can cause the central cloth to separate from the frame thereby causing fall off. Such device is defective in design and not cost-effective.

SUMMARY OF THE INVENTION

The primary objective of the present invention is therefore to provide a foldable trampoline free from the drawbacks of the conventional trampoline described above.

In keeping with the principle of the present invention, the foregoing objective of the present invention is attained by a device which is buckled together between a foldable frame and a stable spring element.

The objective, features and functions of the present invention will be readily understood upon a thoughtful deliberation of the following detailed description of the present invention with reference to the accompanying drawings.

DETAILED DESCRIPTION OF THE INVENTION

Figure 1:
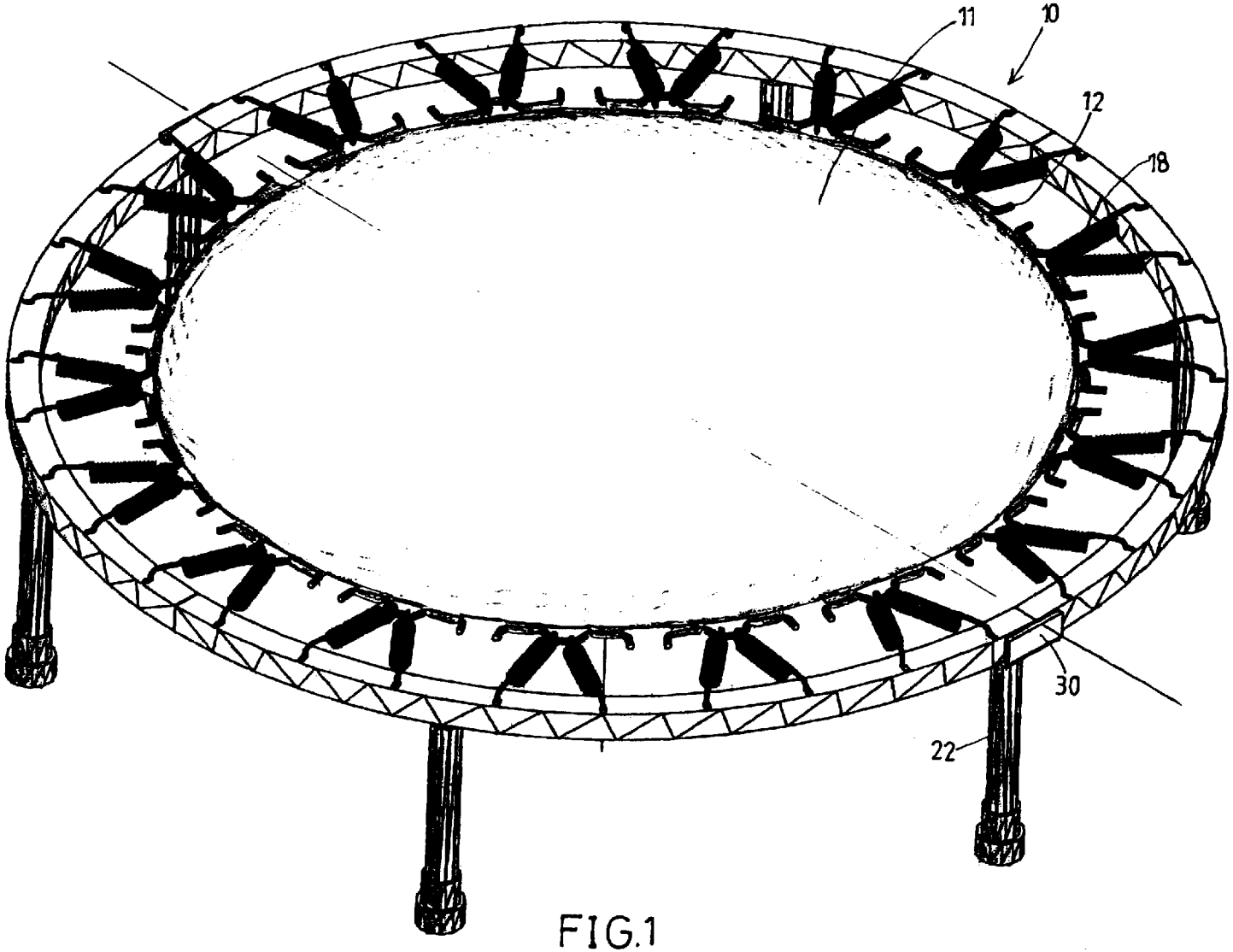
FIG. 1 shows a perspective view of the present invention.
Figure 2:
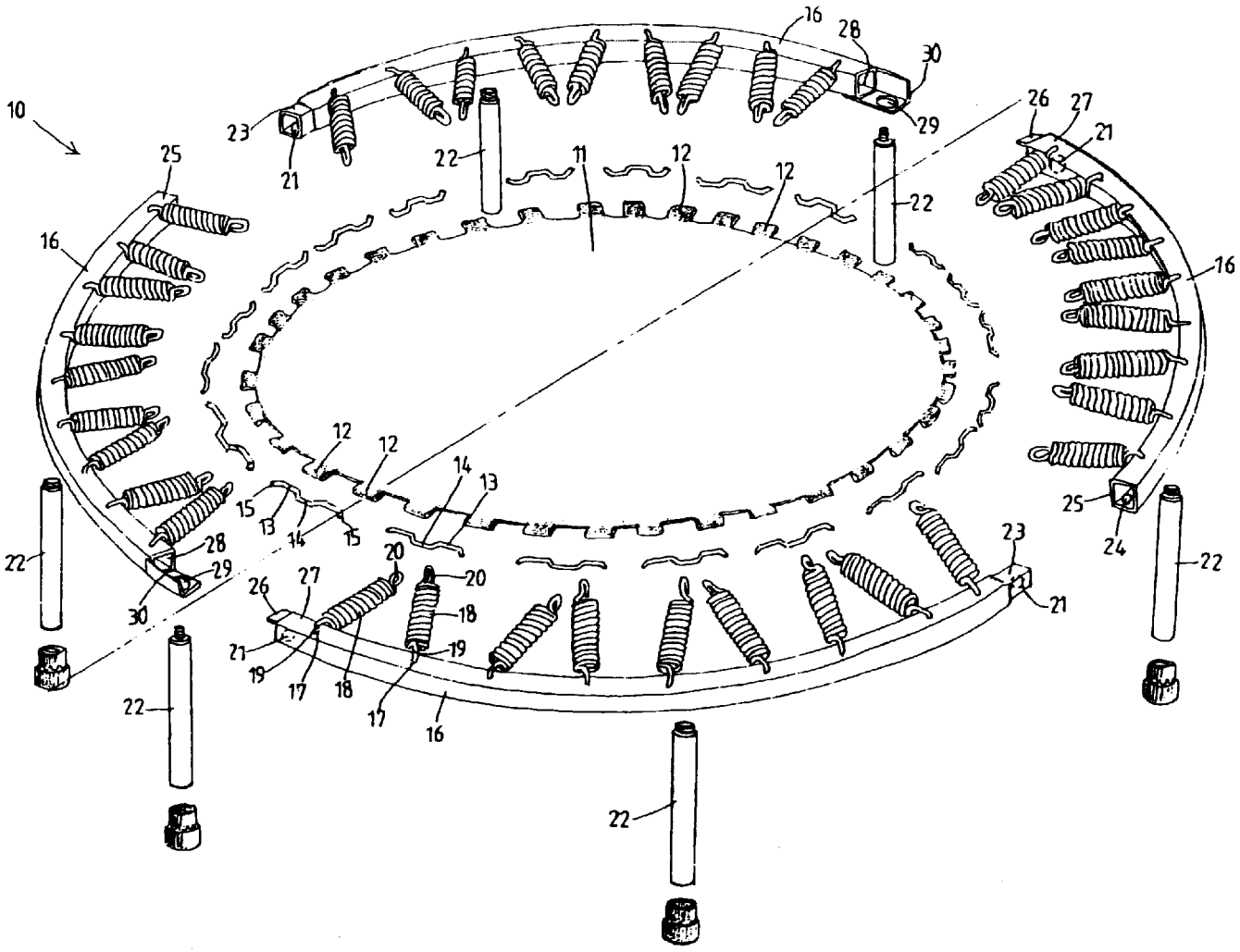
FIG. 2 shows an exploded view of the present invention.

As shown in FIGS. 1 and 2 a foldable trampoline 10 of the present invention is comprised of a jump cloth 11, a frame 16, a plurality of spring elements 18, and a plurality of support rods 22.

The jump cloth 11 is provided with a plurality of cloth ears 12 around the edge so that a center protrusion 14 and restricting ends 15 of a pull rod 13 can pass through the sides of the ears 12.

The frame 16 is provided with a plurality of hook holes 17 at the top surface thereof and further provided with a plurality of thread holes 21 at the bottom surface thereof.

Each of the spring elements 18 is provided with an outer hook 19 for hooking with the hook hole 17 and further provided with an inner curved hook 20 for hooking on the center protrusion 14 of the pull rod 13. The inward curved hook 20 of the spring elements 18 is closed.

The support rods 22 are engaged respectively with the thread hole 21 of the frame 16.

Figure 3:
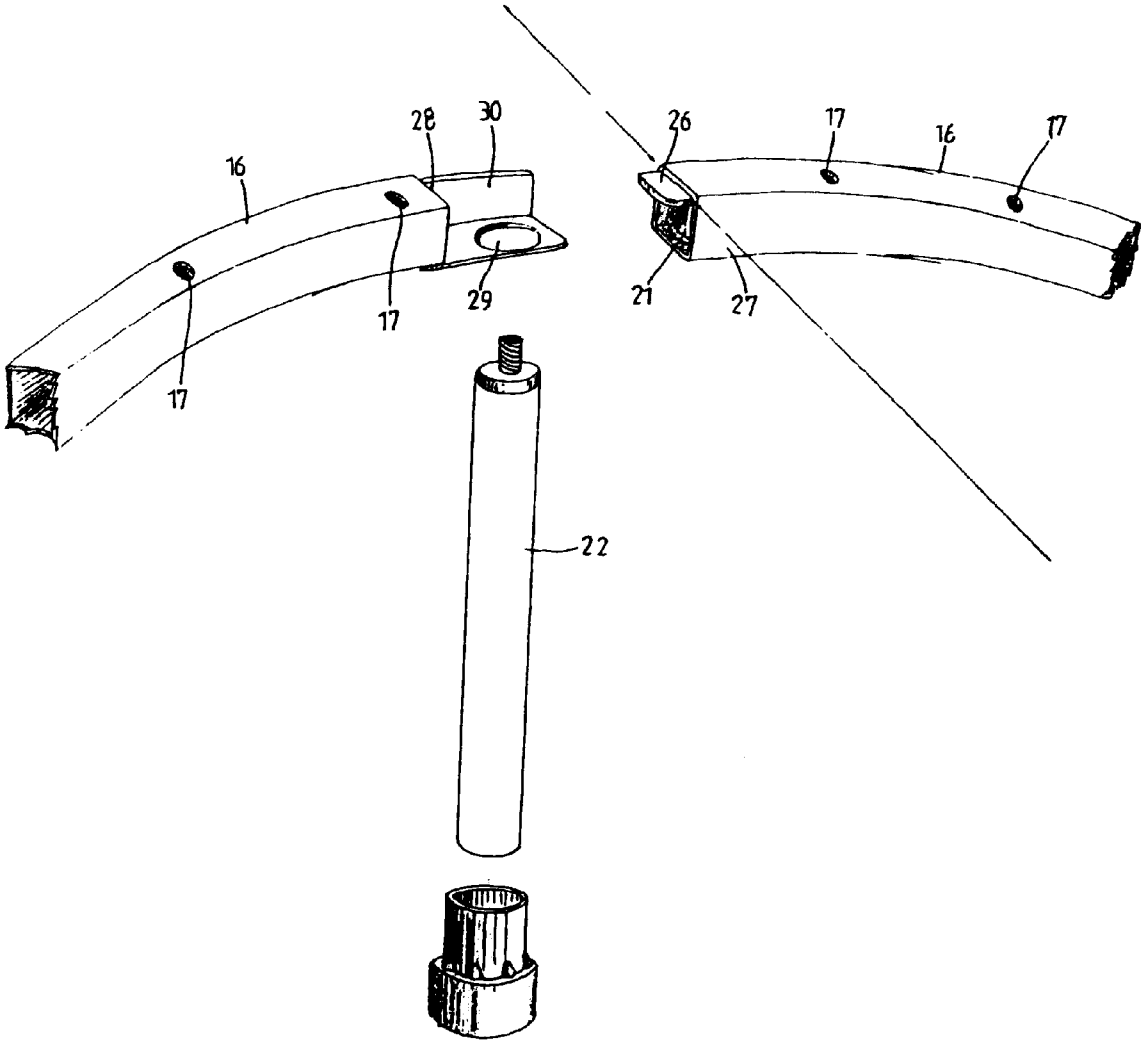
FIG. 3 shows a partial exploded view of a frame of the present invention.
Figure 4:
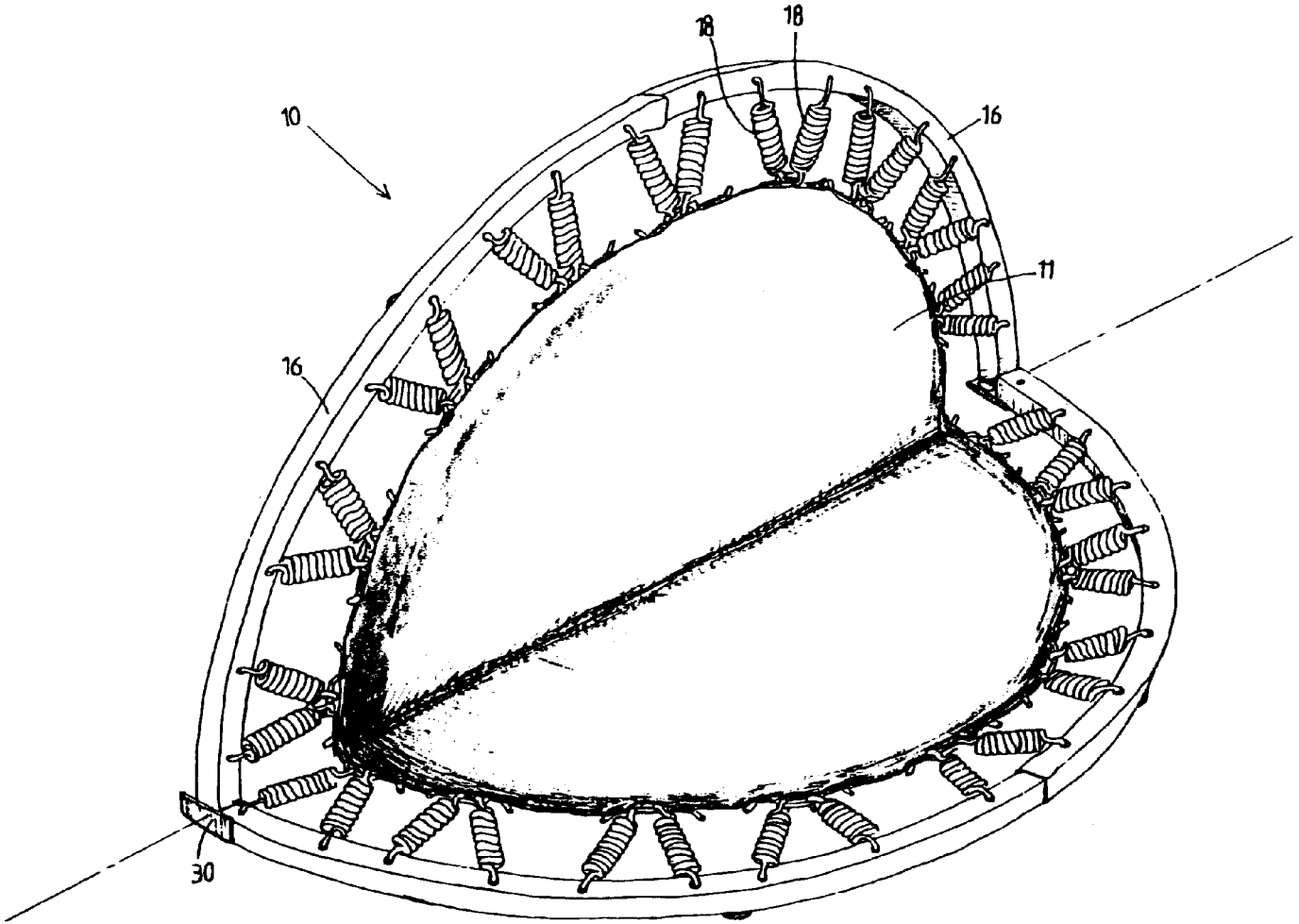
FIG. 4 shows a schematic view of the present invention in folding.

It is a feature of the present invention wherein the frame 16 is assembled through the fastening of the support rods 22. An end of the bed frame 16 is formed with an insert sheath 23 having the thread hole 21 corresponding in location to the end of another section of the frame 16. This end is formed with an opening 25 of the frame hole 24, so that the support rod 22 can pass into the frame hole 24 through the thread hole 21 and then fastening, fixedly with the frame 16. In addition, the other connection side of the section of frame 16 (as shown in FIGS. 2 and 3) is formed with the thread hole 21 and the upper strut 26 of the end 27 extends into the opening 28 which has the frame hole 29 of the L-shaped member 30. The upper strut 26 and the end 27 insert into the opening 28 and lie on the L-shaped member 30. The support rod 22 can pass into the frame hole 29 through the thread hole 21 and then fasten fixedly with the frame 16. If the support rods 22 are taken off, then the frame 16 can be folded (as shown in FIG. 4).

Figure 5:
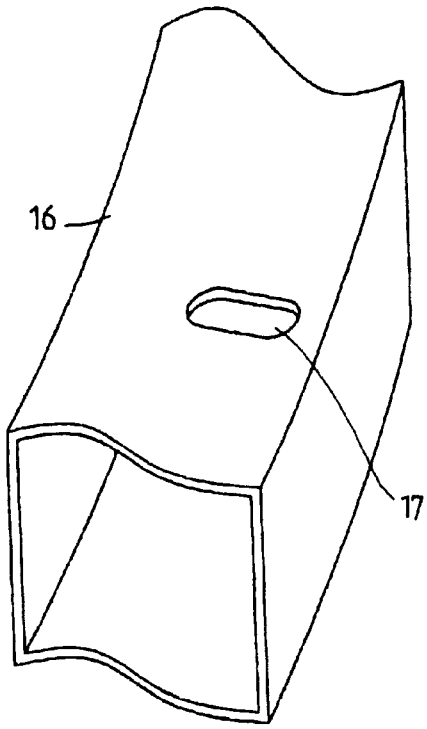
FIG. 5 shows a perspective view of a hook hole of the present invention.
Figure 6:
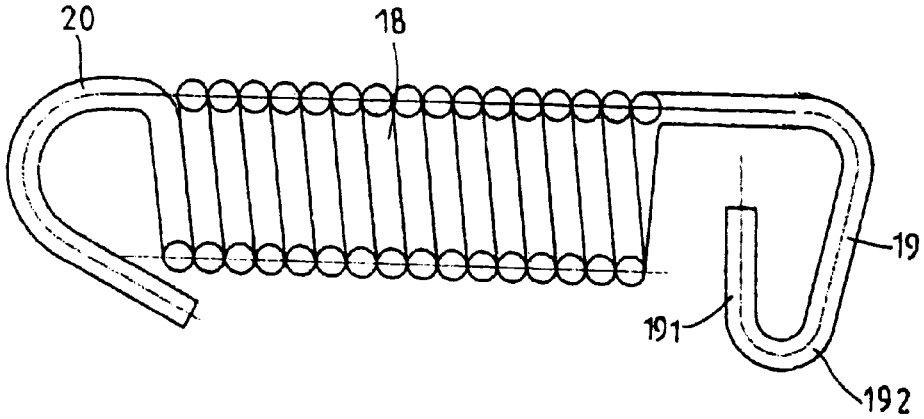
FIG. 6 shows a plan view of a spring element of the present invention.

As shown in FIGS. 5 and 6, the hook hole 17 of the frame 16 is elongated. The Outer hook 19 of the spring element 18 is extended with a tip portion 192 and a hook rod 191 for hooking safely with the hook hole 17 and further hooking at the inner side of the frame 16, so as to prevent the outer hook 19 from releasing from the hook hole 17.

Figure 7:
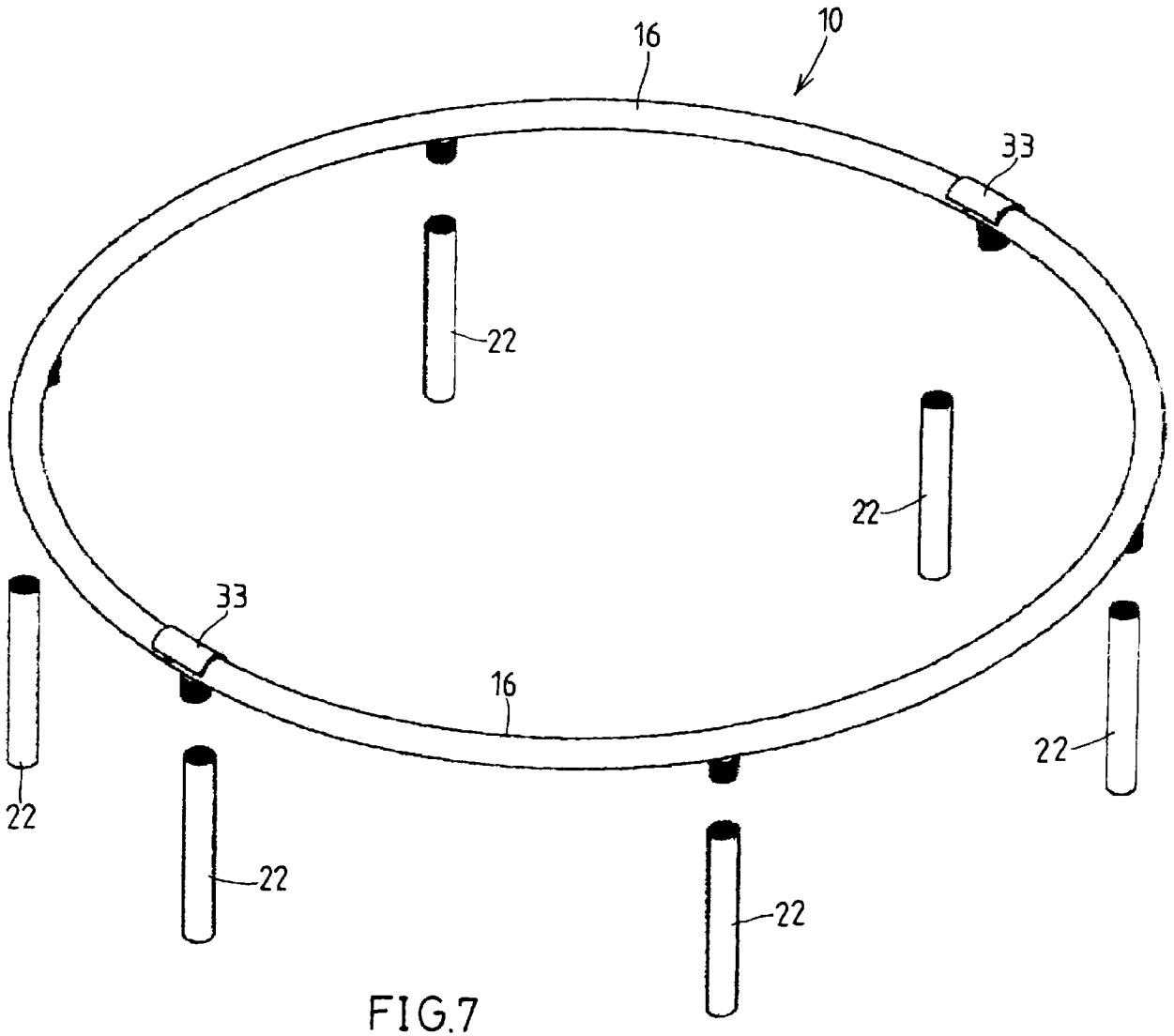
FIG. 7 shows an exploded view of the frame of the present invention.
Figure 9:
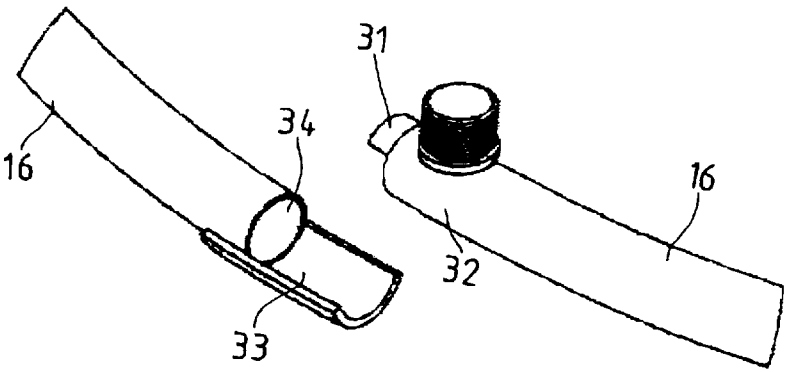
FIG. 9 shows another partial exploded view of the frame of the present invention in connection.
Figure 8:
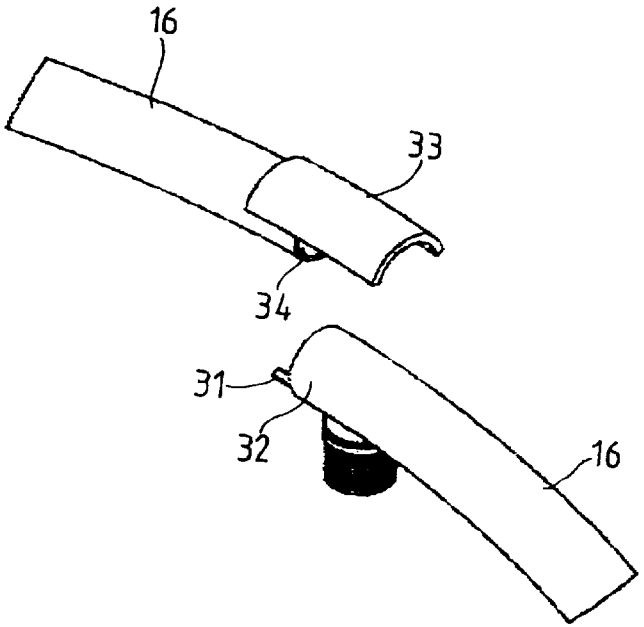
FIG. 8 shows a partial exploded view of the frame of the present invention.
Figure 10:
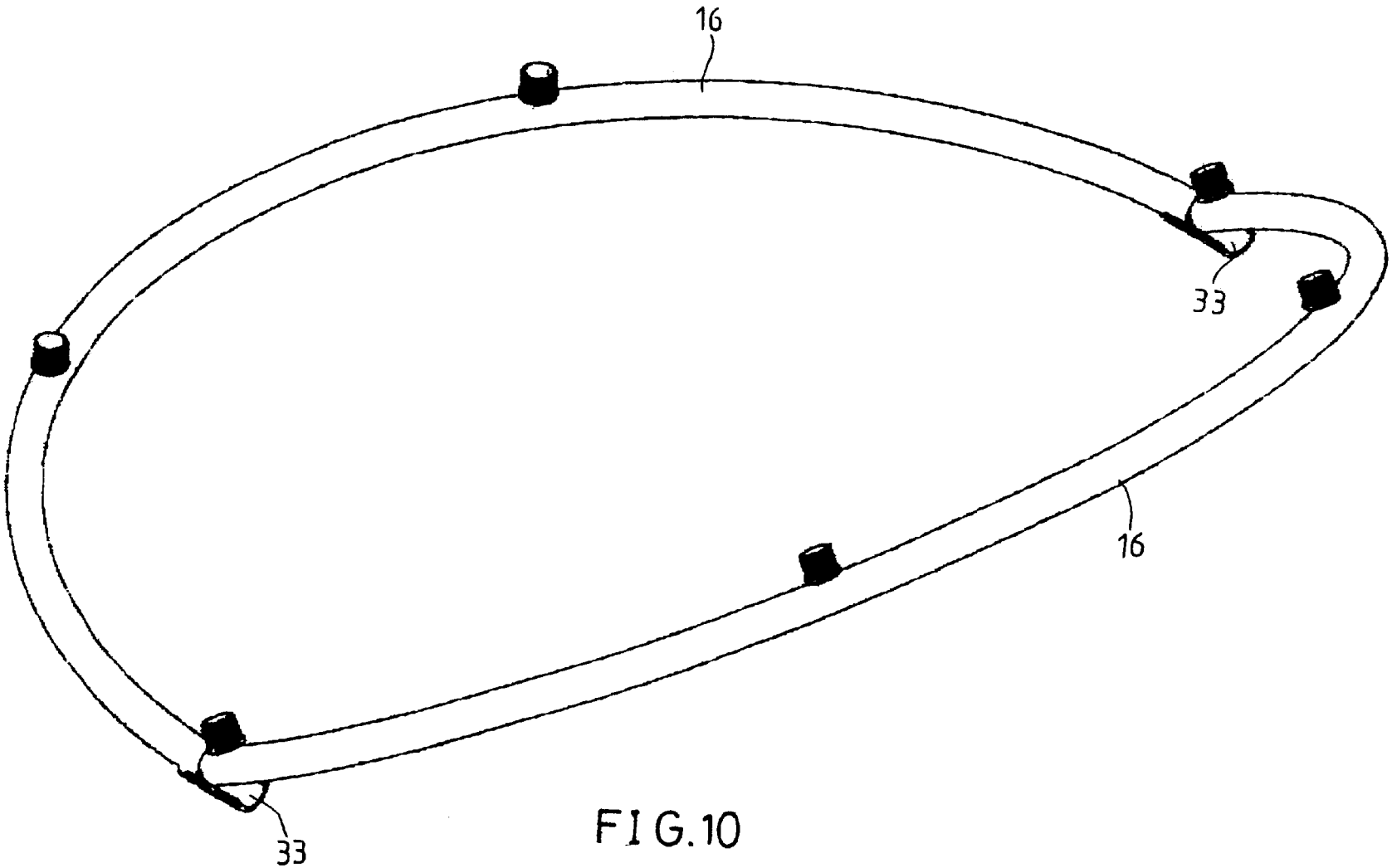
FIG. 10 shows a schematic view of the bed frame of the present invention in folding.

As shown in FIGS. 7–9, the frame is divided into two sections which receive the support rods 22 at the bottom edge. The opposite ends of the frame 16 are formed with a lower strut 31 at end 32 and protruded with an inverted U-shaped member 33 extending from the opening 34. The lower strut 31 and the support end 32 insert into the opening 34 to support the inverted U-shaped member 33, so as to enable the frame 16 to have its sections connected together rigidly and assembled. If the support rods 22 are taken off, then the frame 16 can be folded (as shown in FIG. 10).

The present invention has the advantages which are described hereinafter.

The frame 16 is divided into several sections and combined with each other by the fastening of the support rods 22. The thread hole 21 of the insert sheath 23 is connected with the frame hole 24 of the opening 25 by the support rod 22, so that the frame 16 is fastened firmly together. The upper strut 26 inserts into the opening 28 and the end 27 lies on the L-shaped member 30 enabling the support rod 22 to pass into the frame hole 29 through the thread hole 21, so that the frame 16 is fastened firmly in position. If the support rods are taken off, the bed frame 16 is foldable. The folding and spreading of the spring bed 10 causes the spring elements 18 will expand elastically but will not let the spring elements 18 fall off due to the receipt of the inner curve hook 20 on the protrusion edge 14 and due to the receipt of the tip portion 192 into the hook hole 17. Additionally, the hook rod 191 hooks into the inner side of the frame 16.

The bed frame 16 is further divided into two sections and combined with each other by the connection of the lower strut 31 and the support end 32 into the opening 34, further by the fastening of the support rod 22. If the support rods 22 are taken off, then the frame 16 is foldable.

The embodiment of the present invention described above is to be deemed in all respects as being merely illustrative and not restrictive. Accordingly, the present invention may be embodied in other specific forms without deviating from the spirit thereof. The present invention is therefore to be limited only by the scope of the following appended claims.

What is claimed is:

1. A foldable trampoline comprising:

a jump cloth having a plurality of cloth ears formed in spaced relationship around a periphery thereof;

a plurality of pull rods each having a central protrusion and restricting ends on opposite sides of said central protrusion, said plurality of pull rods respectively received within said plurality of cloth ears;

a frame having a plurality of hook holes formed on a top surface thereof and a plurality of thread holes formed on a bottom surface thereof, said frame having a first section, a second section, a third section, and a fourth section;

a plurality of spring elements each having an outer hook engaged in a respective hook hole of said plurality of hook holes, each of said plurality of spring elements having an inner curved hook engaged respectively with said central protrusion of said plurality of pull rods, said inner curved hook being a closed hook; and a plurality of support rods respectively removably engaged with said plurality of thread holes, one end of each of said first and second sections of said frame having an insert sheath formed thereof, said insert sheath having one of said plurality of thread holes formed therein, said insert sheath received within an opening in one end of each of said third and fourth sections, said opening of each of said third and fourth sections having a thread hole aligned with said thread hole of said insert sheath, said first section having an L-shaped member extending from an opposite end thereof and received within an opposite end of said fourth section, said opposite end of said fourth section having an upper strut extending therefrom and received with said opposite end of said first section, a thread hole of said plurality of thread holes formed in said L-shaped member, said second section having an upper strut extending from an opposite end of said second section, said upper strut of said second section received within an opposite end of said third section, said opposite end of said third section having an L-shaped member extending therefrom and received within said opposite end of said second section, said L-shaped member of said third section having a thread hole aligned with a thread hole formed in said second section.

2. The foldable trampoline of claim 1, each of said plurality of hook holes being an elongated slot, said outer hook having a tip portion and a hook rod engaged within said elongated slot, said outer hook engaged within an interior of said frame such that said tip is in abutment against an interior surface of said frame.

3. The foldable trampoline of claim 1, said L-shaped members being separable respectively from said upper struts when respective support rods are removed from the thread holes of each of said L-shaped members such that one portion of said frame is foldable onto another portion of said frame.

* * * * *